United States Patent [19]

Berger et al.

[11] Patent Number: 4,759,152

[45] Date of Patent: Jul. 26, 1988

[54] ECCENTRIC GRINDER WITH A DEVICE FOR CHANGING A GRINDING MOTION

[75] Inventors: Günther Berger, Notzingen; Dieter Dörr, Filderstadt; Günter Schaal, Stuttgart; Fred Weinmann, Filderstadt, all of Fed. Rep. of Germany

[73] Assignee: Robert Bosch GmbH, Stuttgart, Fed. Rep. of Germany

[21] Appl. No.: 817

[22] Filed: Jan. 6, 1987

[30] Foreign Application Priority Data

Mar. 20, 1986 [DE] Fed. Rep. of Germany ..... 3609441

[51] Int. Cl.[4] ..... B24B 23/03; F16H 1/28

[52] U.S. Cl. ..... 51/120; 51/119; 51/170 MT; 74/804; 74/805

[58] Field of Search ..... 51/119, 120, 90, 170 MT, 51/170 TL; 74/804, 805

[56] References Cited

U.S. PATENT DOCUMENTS 2,794,303 6/1955 Wicks ..... 51/119

3,874,125 4/1975 Stroezel ..... 51/170 MT

FOREIGN PATENT DOCUMENTS 0733899 4/1943 Fed. Rep. of Germany ..... 51/170 MT 0150964 11/1980 Japan ..... 51/170 MT

*Primary Examiner*—Frederick R. Schmidt
*Assistant Examiner*—Blynn Shideler
*Attorney, Agent, or Firm*—Michael J. Striker

[57] ABSTRACT

An eccentric grinder includes a motor-driven shaft, an eccentric drive connected to the shaft to impart to a grinding disc one mode of grinding motion and a rolling drive including friction or toothed crowns on the grinding disc and the housing cooperating with each other to impart to the grinding disc another mode of grinding motion. The grinder is provided with a ring carrying two toothed crowns at the opposite edges thereof and releasably insertable into a recess formed in a ring-shaped element fixed to the housing of the grinder so that one mode of grinding can be easily changed to the other mode of grinding.

9 Claims, 2 Drawing Sheets

ECCENTRIC GRINDER WITH A DEVICE FOR CHANGING A GRINDING MOTION

BACKGROUND OF THE INVENTION

The present invention relates to an eccentric grinder provided with a device for changing a grinding motion so as to adjust the grinder to a coarse grinding and a fine grinding as well.

Eccentric grinders of the foregoing type normally include a device for changing a grinding motion by selecting between a pure eccentric drive of the grinding disc and the drive for the forcible rolling motion of the toothed crowns provided on the housing of the grinder and the grinding disc relative to each other. Such eccentric grinders are available on the market and one of them has been described, for example in "Fachberichte für Metallbearbeitung", Apr. 3, 1983, title "Rotex, die neue Dimension of Schleifens". Despite certain advantages of the conventional eccentric grinders an optimal adjustment of such grinders to requirements of practice has not been possible. The gap between the pure coarse grinding and the fine grinding is too large. In order to overcome this problem it has been proposed to provide a further drive stage with gears or friction wheels of various diameters which however has been conceivable only with considerable enlargement of the elements which constituted the drive. On the other hand, the switching from one type of the drive to the other type of the drive has involved relatively large expenses on adjustment means. The adjustment means for the drive must be robust and should remain troubleless. When the toothed crowns are employed the teeth of the crows can be damaged during the switching from one drive to another drive.

An eccentric grinder with a device for changing a grinding motion is disclosed in the previously filed U.S. pending application of the same assignee No. 06-921776.

SUMMARY OF THE DISCLOSURE

It is an object of the present invention to provide an improved eccentric grinder.

It is another object of the invention to provide a grinder of an optimal output and simple and compact construction.

These and other objects of the invention are attained by an eccentric grinder, comprising housing; a motor-driven drive shaft; a grinding disc; a pure eccentric drive connected to said shaft for driving said disc in one mode of grinding; a further drive for driving said disc in another mode of grinding and including at least friction and toothed crowns positioned on said housing and said grinding disc, respectively, and forcibly rollable on each other, wherein a crown on said housing is concertrical with said drive shaft and a crown on said grinding disc is eccentric to and rotatably supported on said drive shaft; and means for changing a grinding movement of said disc, the improvement comprising said means including an element rigidly connected to said housing and having a recess; and a ring, said grinding disc carrying at least one crown and said ring also carrying at least one crown engageable with said crown of said disc; said ring being easily releasable from and connectable to said housing by means of said recess.

Due to the easily releasable connection of the ring carrying toothed crowns for a drive for forcible rolling of the toothed crowns of the grinding disc and the toothed crowns of the housing the adjustment from a pure eccentric drive of the grinding disc to the drive with forcible rolling is possible without additional adjusting means. When the ring is inserted into the recess of the element rigidly connected to the housing of the grinder the toothed crown of this ring cooperates with the toothed crown on the grinding disc and causes a rolling motion which results in a cycloidal grinding finish. If the ring is removed from that recess a pure eccentric drive of the grinding disc is obtained. Thus the grinding disc is merely detached from the housing of the grinder and the ring is either inserted into that recess or removed therefrom. The specific adjusting elements are superfluous.

Said ring may have two toothed crowns provided at two opposite edges thereof, said grinding disc supporting a further toothed crown, wherein said ring is insertable into said recess in one position in which one of the toothed crowns of said ring is engageable with said one crown of said grinding disc or in a position turned by 180°, in which another of said toothed crowns of said ring is engageable with said further toothed crown of said grinding disc. This structure is specifically advantageous.

The element fixed to the housing may be a ring in which said recess has a circular shape. Said ring may have at said recess an internal toothed crown engageable with said one crown of said ring and an external toothed crown engageable with said another of said toothed crowns of said ring, said one crown being an external toothed crown and said another of said crowns being an internal toothed crown.

Said recess may have limiting surfaces coated with material of high friction coefficient.

The ring rigidly connected to said housing may be made of material of high friction coefficient.

The housing-fixed ring may have a conical cross-section with a cone angle selected so that a self-locking connection occurs between said ring and the ring carrying at least one crown.

The internal and external crowns at said recess may be provided with tooth gaps.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
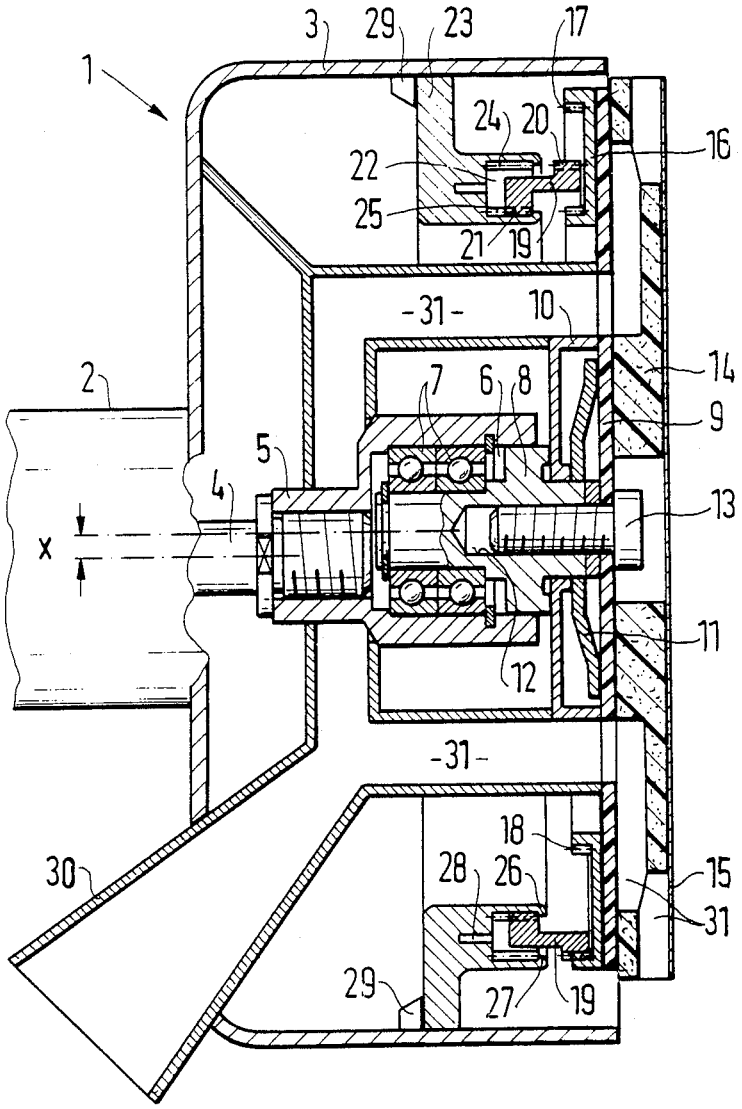
FIG. 1 is an axial sectional view of the eccentric grinder according to the invention in the region of the drive and the grinding disc, wherein the external toothed crown of the housing rolls on the internal toothed crown of the grinding disc.
Figure 2:
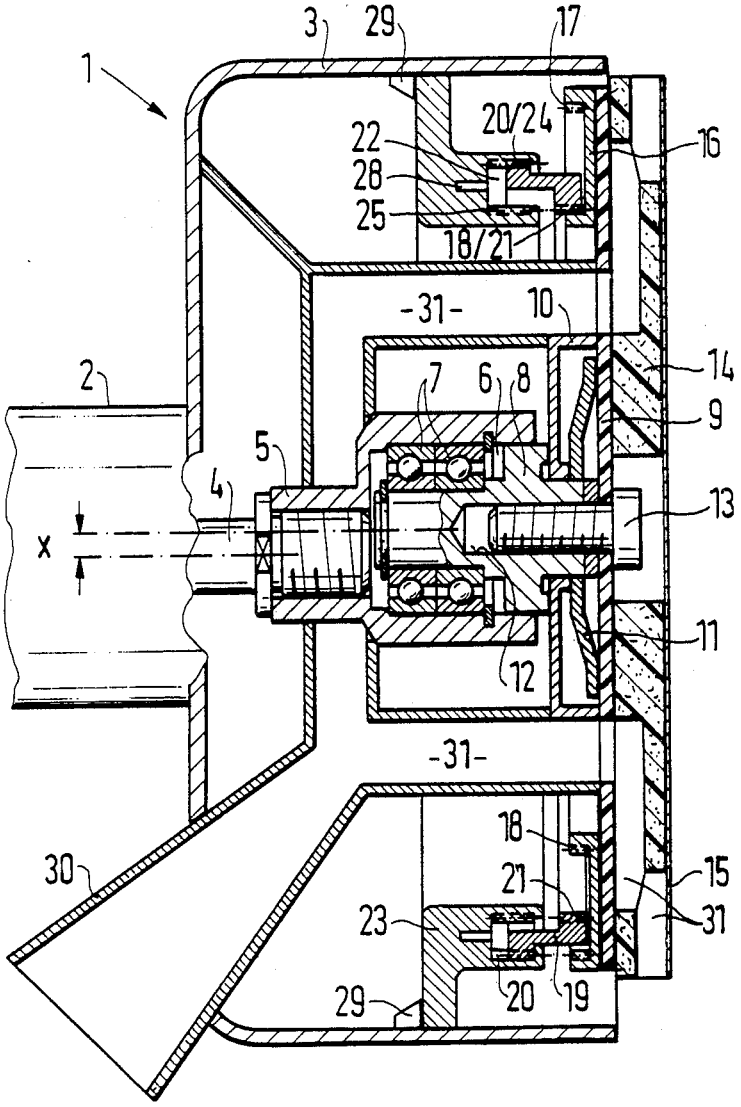
FIG. 2 is an axial sectional view similar to that of FIG. 1 but in the position in which the housing-fixed internal toothed crown rolls on the external toothed crown provided on the grinding disc.

Referring now to the drawings in detail, the eccentric grinder of the invention designated by reference numeral 1 includes a housing 2 which forms a bell 3. A motor (not shown), a drive shaft 4 of which is illustrated in the drawings, is positioned in the housing 2. The drive shaft 4 extends into the interior of bell 3 and carries thereon an intermediate piece 5. This intermediate piece 5 is formed as a crank and has a cylindrical recess 6 which is eccentric to the axis of the drive shaft 4. The eccentricity that is the distance between the axis of drive shaft 4 and the central axis of recess 6, is denoted by X. Two spaced ball bearings 7 are positioned in the recess 6. These bearings receive a journal or sleeve 8 for supporting a grinding disc 9.

A cup-shaped rotation element 10, a spring washer 11 and a bolt 13 which is screened in a threaded bore 12 formed in the sleeve 8 serve to secure the grinding disc 9 to the sleeve 8. A soft-elastic coating 14 is glued to the outer end face of the grinding disc 9. This coating serves to receive suitable grinding sheets 15. At the inner end face the grinding disc 9 supports a double toothed crown 16 which is concentrical to the axis of elongation of the sleeve 8 and is thus eccentric to the axis of the drive shaft 4. The double toothed crown 16 has an internal toothed crown 17 and an external toothed crown 18. A toothed ring 19 is adjusted to cooperate with the double toothed crown 16 and is for this purpose provided with an external toothed crown 20 and an internal toothed crown 21. The ring 19 is slightly releasably-connectable with the housing 2 by means of a circular recess 22 formed on a ring 23 which is rigidly positioned in housing 2. The recess 22 has an internal toothed crown 24, an external toothed crown 25 which are respectively adjusted to the external toothed crown 20 and the internal toothed crown 21 of the ring 19. Elastic rims or edges 26 and 27 are provided in the ring 23 for locking the toothed ring 19 when this ring is inserted either with it toothed crown 20 or toothed crown 19 into engagement with the toothed crown 24 or toothed crown 25 of recess 22, respectively. In order to provide better elastic properties of the recess 22 a slot 28 is additionally formed in the stationary ring 23.

The housing-fixed ring 23 is preferably made of elastic material with a relatively high friction coefficient and is applied to a radial lip or projection 29 which is formed on the bell 3. Thereby the housing-fixed ring 23 can be pressed on or glued in the bell 3. When the toothed crowns 24 and 25 are provided with tooth gaps, for example only each second tooth is formed thereon, the recess 22 for receiving the toothed ring 19 is non-susceptible to dust. The removal of the toothed ring 19 and its renew insertion is therefore facilitated. When the toothed ring 19 is removed from recess 22 the drive of the grinding disc 9 for a predetermined grinding motion is obtained not forcibly but rather via the intermediate piece 5 with its eccentric recess 6. The supporting of the sleeve 8 in the ball bearings in this recess 6 ensures that the grinding disc 9 is freely rotatable about the axis of sleeve 8. This disc therefore executes during the grinding process the motion which follows the cycloid with the superposed rotational movement whereby the overlapping or superposing of this rotational movement depends upon counter pressure during the grinding. The path of each individual grinding grain per one eccentric rotation is very small so that a very fine grinding finish results. The material removed is respectively small. This grinding motion is particularly suitable for grinding multi-stage transition zones of the articles of manufacture. If the toothed ring 19 is inserted in the recess 22 in the manner shown in FIG. 1 and the grinding disc 9 is in the position shown in FIG. 1 the external toothed crown 20 of ring 19 comes into engagement with the internal toothed crown 17 of the double toothed crown 16. Since during the grinding, the toothed ring 19 is stationary the internal toothed crown 17 rolls on the external toothed crown 20. Each grinding grain of the grinding sheet 19 attached to the grinding disc 9 describes during the grinding process, due to this adjustment, a pericycloid in which this rotation movement direction coincides with the rotation direction of the eccentric. Thereby the path of grinding grains per one revolution of the eccentric is the greatest. This grinding movement causes the largest material removal and is thus suitable for the coarse grinding and not suitable for the fine grinding, for example of transition zones of the articles being treated. If, after the detaching of the grinding disc 9, the ring 19 is removed from recess 22, this ring is turned over by 180° and is again inserted into recess 22, so that, after the attaching of the grinding disc 9 to the sleeve 8, the external toothed crown 18 of the double toothed crown 16 comes into engagement with the internal toothed crown 21. Inasmuch as during the grinding, the internal toothed crown 21 is immovable the toothed crown 18 rolls on the toothed crown 21 and thus determines or adjusts the grinding motion of the grinding disc 9. Each grinding grain on the grinding sheet 15 describes an elongated hypocycloid whereby it moves in the direction counter to the direction of rotation of the eccentric. This results in a greater material removal than during the first-described grinding process without the forced rolling movement, but in a lesser material removal that in the afore-described grinding movement. Accordingly a finer grinding finish is obtained. With this adjustment, transition zones of multi-step surfaces of the articles being treated can be easily ground.

It is also expedient for a fine grinding that the drive connection between the double toothed crown 16 and the ring 19 be loosened by the removal of ring 19.

Reference numeral 30 designates a connection by means of which a suction passage 31 provided in the interior of the bell 3 can be connected to a dust suction device.

It will be understood that each of the elements described above, or two or more together, may also find a useful application in other types of eccentric grinders differing from the types described above.

While the invention has been illustrated and described as embodied in an eccentric grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt i- for various applications without omitting features that, from the standpoint of prior art, fairly constitute essential characteristics of the generic or specific aspects of this invention.

What is claimed as new and desired to be protected by Letters Patent is set forth in the appended claims.

1. In an eccentric grinder, comprising a housing; a motor-driven shaft; a grinding disc; a pure eccentric drive connected to said shaft for driving said disc in one mode of grinding; a further drive for driving said disc in another mode of grinding and including at least friction and toothed crowns positioned on said housing and at least friction and toothed crowns positioned on said grinding disc wherein said crowns positioned on said housing are forcibly rollable on said crowns positioned on said grinding disc and one of said crowns (20) positioned on said housing is concentrical with said drive shaft and one of said crowns (17) positioned on said grinding disc is eccentric to and rotatably supported on said drive shaft; and means for changing a grinding movement of said disc, the improvement comprising said means including an intermediate element (23) rigidly connected to said housing and having a recess (22); and a ring-shaped member (19), said grinding disc (9) carrying one of said crowns (17), and said ring-shaped member (19) also carrying one of said crowns (20) which is engageable with said one of said crowns (17) of said grinding disc, said ring-shaped member being easily releasable from and connectable to said housing by means of said recess, said ring-shaped member (19) carrying another at least friction and toothed crown (21), said one crown (20) and said another crown (21) being formed at two edges of said ring-shaped member (19), respectively, said grinding disc supporting a further at least friction and toothed crown (18), wherein said ring-shaped member (19) is insertable into said recess in one position in which said one crown (20) of said ring-shaped member is engageable with said one crown (17) of said grinding disc or in another position turned by 180°, in which said another crown (21) of said ring-shaped member is engageable with said further toothed crown (18) of said grinding disc.

2. The eccentric grinder as defined in claim 1, said intermediate element being a ring (23) formed with said recess which is circular, said ring having a conical cross-section with a cone angle selected so that a self-locking connection occurs between said ring (23) and the ring-shaped member (19).

3. The eccentric grinder as defined in claim 1, wherein said all crowns are toothed crowns.

4. The eccentric grinder as defined in claim 3, wherein said recess is circular, said intermediate element rigidly connected to said housing being formed by a ring (23) which has at said recess an internal toothed crown (24) engageable with said one crown (20) of said ring-shaped member and an external toothed crown (25) engageable with said another crown (21) of said ring-shaped member (19), said one crown (20) of said ring-shaped member being external toothed crown and said another crown (21) of said ring-shaped member being an internal toothed crown.

5. The eccentric grinder as defined in claim 4, wherein said recess has elastic edges.

6. The eccentric grinder as defined in claim 4, wherein said recess has limiting surfaces coated with material of high friction coefficient.

7. The eccentric grinder as defined in claim 4, wherein said ring (23) is made of material of high friction coefficient.

8. The eccentric grinder as defined in claim 4, wherein said internal and extenal crowns at said recess are provided with tooth gaps.

9. The eccentric grinder as defined in claim 4, wherein said recess is segment-shaped.

* * * * *